US006536324B1

(12) United States Patent
Boissiere et al.

(10) Patent No.: US 6,536,324 B1
(45) Date of Patent: Mar. 25, 2003

(54) ANTI-RECOIL DEVICE WITH BRAKE, BRAKE COMPENSATOR AND RECUPERATOR

(75) Inventors: Bruno Boissiere, Olivet (FR); Eric Metroz, La Ferte Saint Aubin (FR); Jean-Marie Poussard, La Ferte Saint Aubin (FR); Pascal Rondet, Orleans (FR)

(73) Assignee: TDA Armements S.A.S., La Ferte Saint Aubin (FR)

( * ) Notice: Subject to any disclaimer, the term of this patent is extended or adjusted under 35 U.S.C. 154(b) by 0 days.

(21) Appl. No.: 09/926,019

(22) PCT Filed: Feb. 11, 2000

(86) PCT No.: PCT/FR00/00348

§ 371 (c)(1),
(2), (4) Date: Aug. 15, 2001

(87) PCT Pub. No.: WO00/49358

PCT Pub. Date: Aug. 24, 2000

(30) Foreign Application Priority Data

Feb. 16, 1999 (FR) ..... 99 01863

(51) Int. Cl.[7] ..... F41A 3/78
(52) U.S. Cl. ..... 89/14.3; 89/191.01; 89/198
(58) Field of Search ..... 89/14.3, 1.703, 89/191.01, 191.02, 199, 43.01, 198

(56) References Cited

U.S. PATENT DOCUMENTS

| | | | | | |
|---|---|---|---|---|---|
| 2,574,060 | A | * | 11/1951 | Prache | 89/43.01 |
| 3,698,284 | A | * | 10/1972 | Toering et al. | 188/289 |
| 3,745,880 | A | * | 7/1973 | Metz et al. | 89/43.01 |
| 4,599,933 | A | * | 7/1986 | Stoner | 89/25 |
| 4,774,873 | A | * | 10/1988 | Shoales | 89/198 |
| 4,827,829 | A | * | 5/1989 | Stoner | 188/314 |
| 4,924,751 | A | * | 5/1990 | Metz et al. | 188/316 |
| 6,095,026 | A | | 8/2000 | Poussard et al. | |

FOREIGN PATENT DOCUMENTS

| | | | | |
|---|---|---|---|---|
| DE | 103 975 | * | 8/1898 | 89/43.01 |
| DE | 2 053 098 | * | 5/1972 | 89/43.01 |
| FR | 191 450 | * | 6/1888 | 89/43.01 |
| FR | 1 231 005 | * | 9/1960 | 89/43.01 |
| JP | 52-16900 | * | 8/1997 | 89/43.01 |

* cited by examiner

*Primary Examiner*—Michael J. Carone
*Assistant Examiner*—Gabriel S. Sukman
(74) *Attorney, Agent, or Firm*—Oblon, Spivak, McClelland, Maier & Neustadt, P.C.

(57) ABSTRACT

The invention relates to anti-recoil devices for guns and martars.

The anti-recoil device has a brake with a principal cabity which houses a principal piston pierced with holes. The small chamber of the brake is connected by an opening to a subisdiary chamber closed by a fluid-tight piston. The principal cavity and the subsidiary chamber are filled with a liquid whilst a gas under pressure, located on the other side of the fluid-tight piston with respect to the subsidiary chamber, tends to push back the subsidiary piston. A valve partially obturtes the holes of the principal piston, during the return to firing position, in order to brake that return.

5 Claims, 3 Drawing Sheets

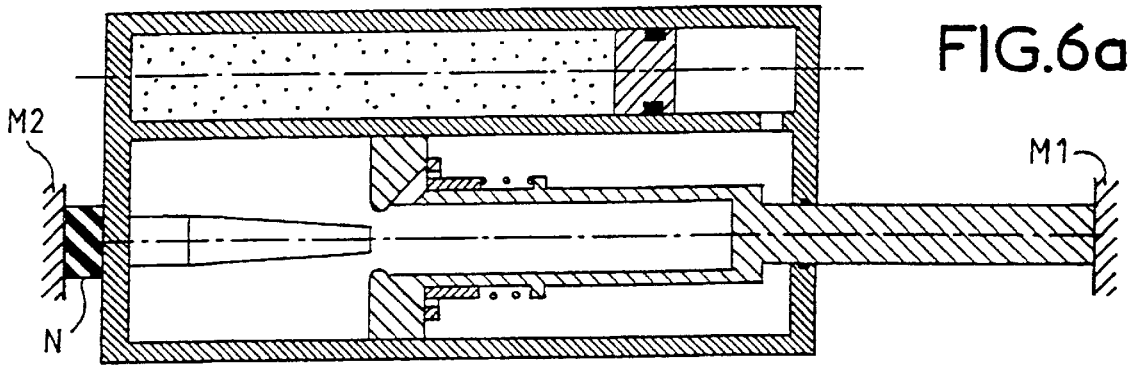
FIG.6a
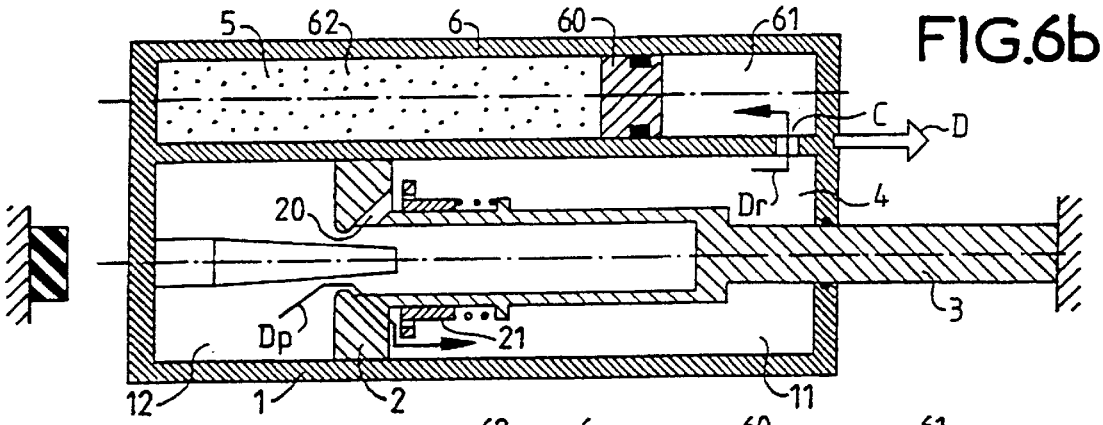
FIG.6b
FIG.6c
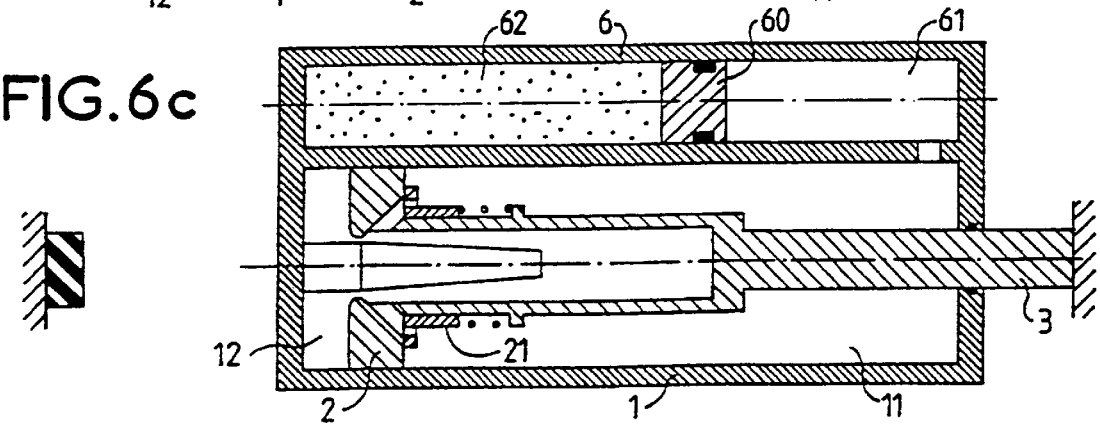
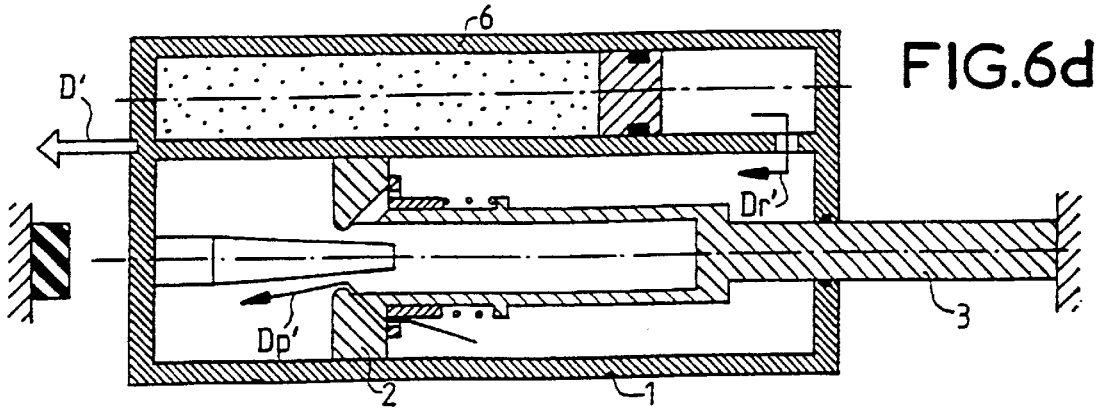
FIG.6d

ANTI-RECOIL DEVICE WITH BRAKE, BRAKE COMPENSATOR AND RECUPERATOR

BACKGROUND OF THE INVENTION

Field of the Invention

The present invention relates to anti-recoil devices for guns and mortars and more precisely to anti-recoil devices which comprise a recoil brake and, associated with that brake, a compensator and a recuperator.

It is known to reduce the effects of the recoil of a gun or a mortar by means of a recoil brake. It is known to adjoin a compensator and a recuperator to the recoil brake: the German patent DE 103 975 of Aug. 18, 1898 proposes an anti-recoil device wherein a brake equipped with a compensator functions, in addition to functioning as a brake, as a recuperator.

SUMMARY OF THE INVENTION

The device according to this, patent can be described as being an anti-recoil device which comprises a recoil brake serving as a recuperator and a compensator coupled to the brake by a duct, the brake comprising a principal cavity, a principal piston pierced with holes and a principal rod with one end integral with the piston and one end outside of the cavity, the piston forming an imperfect barrier which subdivides the cavity into a small chamber inside of which the rod passes and a big chamber, the compensator comprising a subsidiary cavity, a subsidiary fluid-tight piston to delimit a subsidiary chamber inside the subsidiary cavity, and a return system which acts on the subsidiary piston in such a way as to tend to reduce the volume of the subsidiary chamber, the device having its principal cavity and its subsidiary chamber filled with liquid, the duct interconnecting the small chamber and the subsidiary chamber and the system being provided in order to be used with the small chamber which increases in volume during the recoil.

In the device according to the patent DE 103 975, in order that the speed of displacement of the principal piston may be braked during the return to the firing position, the subsidiary chamber is not directly connected with the duct but via channels pierced in a fixed piston; the subsidiary piston slides between the fixed piston which it surrounds and the lateral walls of the subsidiary cavity which surrounds it; the speed reduction is obtained by means of valves which close, but only partially, the channels during the return.

The assembly formed by the subsidiary piston and the fixed piston with its channels and its valve is complicated to produce, costly and relatively fragile.

The purpose of the present invention is to avoid these disadvantages.

This purpose is achieved, in particular, by mounting the valve on the principal piston of an anti-recoil device such as defined in claim 1.

BRIEF DESCRIPTION OF THE DRAWINGS

The present invention will be better understood and other features will appear with the help of the following description and of the figures relating to it which show:

FIGS. 6*a*, 6*b*, 6*c*, and 6*d*, show the device of FIG. 5 in four positions which it occupies successively during a firing of the weapon system with which it is incorporated.

DETAILED DESCRIPTION OF THE PREFERRED EMBODIMENTS

In the various figures, corresponding elements are denoted by the same references. Furthermore, it should be noted that all of the figures correspond to weapon systems which, by convention, are disposed to fire munitions in a direction parallel to the small sides of the page and oriented towards the large left-hand side of the page; furthermore, in order to simplify the figures, the tubes which are used for firing the munitions and which will be referred to as firing tubes below, have not been shown.

Figure 1:
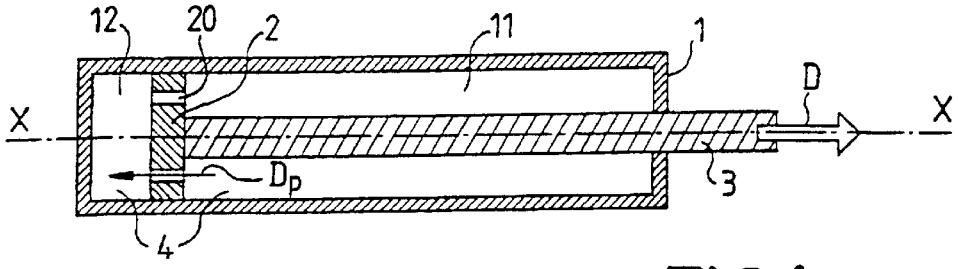
FIG. 1, is a recoil brake seen in cross section.

FIG. 1 is a diagrammatic longitudinal cross sectional view of a recoil brake. This brake comprises a cavity 1 filled with a liquid 4, a piston 2 which can move in a direction XX inside the cavity and a rod 3 integral with the piston; the liquid 4 is generally oil. The cavity has a longitudinal axis XX parallel with the direction of fire of the weapon system in question; this cavity is of constant cross section, generally circular. The rod is parallel with the direction XX and its first end is fixed to the piston; it traverses the wall of the cavity through an opening whose fluid-tightness is provided by a seal, in such a way as to have its second end outside of the cavity and to allow a displacement of the piston inside the cavity, without loss of liquid. The piston defines two chambers in the cavity; these chambers are generally called the small chamber in the case of the one, 11, located on the same side of the piston 2 as the rod 3 and the big chamber in the case of the other one, 12. The piston is pierced with holes, such as the hole 20, whose dimensions are calibrated to ensure the desired intensity of braking; the smaller the total transverse cross section of these holes, the greater the resistance to exchanges of fluid between the two chambers.

In FIG. 1 it is assumed that, at the moment the brake is observed, the relative movement of the piston 2 with respect to the cavity 1 is that during which the length of the rod located outside of the cavity is increasing whilst the volume of the small chamber is reducing and that of the big chamber is increasing; in FIG. 1, the displacement of the rod with respect to the cavity is symbolized by an arrow D and the transfer of liquid caused, through the piston 2, by the changes in volume of the chambers is symbolized by an arrow Dp.

Brakes can be used in four different configurations depending on whether the firing tube is integral with the rod or with the wall of the cavity and depending on whether, during the recoil, the displacement of the rod with respect to the cavity causes a reduction in the volume of the small chamber or an increase in that volume. FIGS. 2*a* to 2*d* illustrate these four configurations in simplified diagrams where the cavity 1 is drawn in cross section in order to show the piston 2 and the rod 3. In these diagrams arrows, T, oriented from right to left indicate the firing direction and therefore symbolize the firing tube; these arrows are connected, by a length of straight dashed line, either to the rod or to the cavity depending on whether the rod or the cavity is integral with the firing tube and therefore depending on whether the cavity or the rod is integral with the support of the weapon system in question: an arrow D associated with the part of the brake which is integral with the firing tube indicates the displacement of that part of the brake during the recoil. In correlation with the arrow T associated with the mobile part of the brake, a cross-hatched rectangle, M, is associated with the fixed part of the brake and symbolizes the support of the weapon system.

Figure 2A:
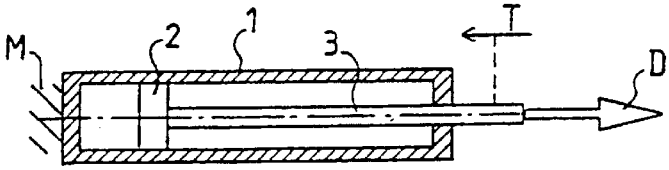
FIGS. 2*a*, 2*b*, 2*c*, and 2*d*, show the different ways of using a recoil brake.

In the case of FIG. 2*a*, the cavity 1 is fixed and the recoil causes a reduction in the volume of the small chamber; the rod 3 works in tension.

Figure 2B:
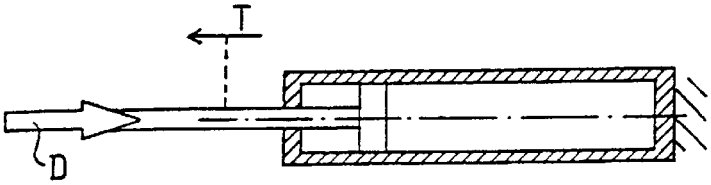

In the case of FIG. 2*b*, the cavity is also fixed but the recoil increases the volume of the small chamber; the rod 3 then works in compression.

Figure 2C:
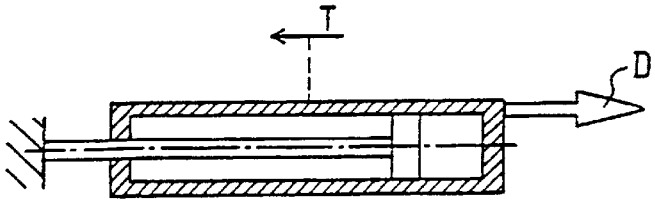

In the case of FIG. 2*c*, the rod 3 is fixed and the recoil causes a reduction in the volume of the small chamber; the rod works in tension.

Figure 2D:
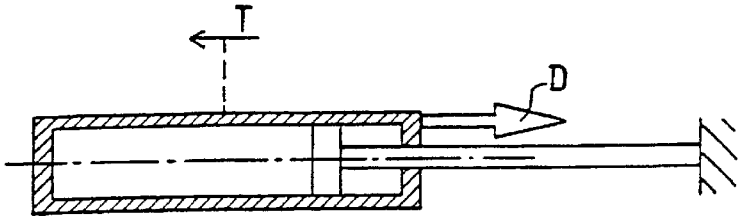

In the case of FIG. 2*d*, the rod 3 is also fixed but the recoil causes an increase in the volume of the small chamber; the rod 3 therefore works in compression.

Figure 3:
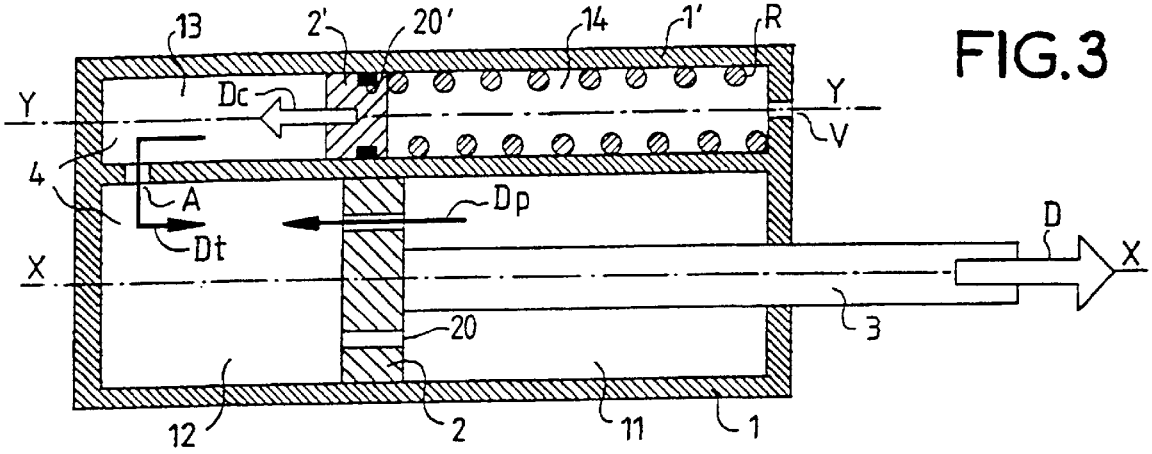
FIG. 3, is a cross-sectional view of a recoil brake associated with a compensator.

The displacement of the piston-rod assembly inside the cavity causes a variation of the volume available for the liquid in the big and small chambers. FIG. 3 shows how a compensator can be associated with a brake of the type which has been described with reference to FIG. 1 in order to compensate for these variations in volume and, at the same time, compensate for the variations in the volume of liquid due to thermal expansions.

The assembly according to FIG. 3 comprises a brake similar to that shown in FIG. 1 except that it has an opening, A, in the wall of the cavity 1 in the vicinity of that of the two ends of the cavity which is located in the big chamber. This assembly also comprises a subsidiary cavity 1', of longitudinal axis YY parallel to XX; a piston 2' can slide in this cavity, where, with the help of a seal 20', it constitutes a fluid-tight barrier between, on the one hand, a compensation chamber 13 and, on the other hand, a subsidiary chamber 14. The compensation chamber is filled with the same liquid, 4, as the cavity 1 with which it is connected by the opening A. The subsidiary chamber 14 is connected with the ambient atmosphere through a hole V; this subsidiary chamber serves as a housing for a coil spring, R; this spring which creates a pressure inside the compensation chamber 13, absorbs, by action on the piston 2', the variations in volume of the compensation chamber 13.

Thus, when the displacement of the rod with respect to the cavity, in the direction of an arrow D, reduces the length of the rod 3 which is inside the cavity, there is produced:

- a flow of liquid from the small chamber to the big chamber because of the reduction in the volume of the small chamber; an arrow Dp symbolizes this flow
- an increase in the overall volume available for the liquid in the cavity, because the volume occupied by the rod in the cavity reduces; this results in an increase in the pressure of the liquid in the chamber 11 and, consequently, a displacement of the piston 2' under the action of the spring R in order to reduce the volume of the compensation chamber; an arrow Dc symbolizes this displacement of the piston 2' and an arrow Dt symbolizes the resultant flow of the liquid from the compensation chamber 13 to the big chamber 12.

It should be noted that, among other variants of the assembly according to FIG. 3, the subsidiary chamber 14 can have no connection with the outside atmosphere and the spring can be replaced by a gas under pressure or the spring R can be located in the compensation chamber and work in tension. Similarly, it is in no way essential that the subsidiary chamber 1' should have its axis YY parallel with the axis XX of the cavity 1; it can even be directly mechanically connected with the cavity 1 only by a duct which, like the opening A according to FIG. 3, would connect the big chamber and the compensation chamber.

The replacing of a firing tube into its initial position, after it has fired a munition and recoiled during that firing, is generally carried out by a hydro-pneumatic recuperator; the function of the recuperator is to store a portion of the recoil energy in order subsequently to return it in order to bring the tube back to its initial position.

Figure 4:
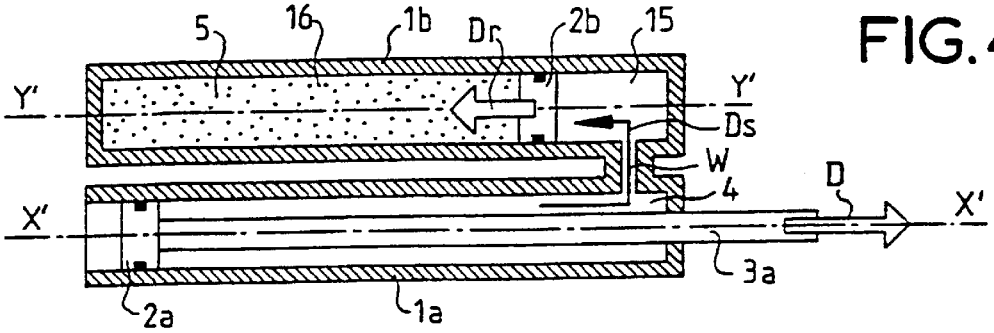
FIG. 4, is a cross sectional view of a recuperator.

FIG. 4 is a diagram of an example embodiment of such a recuperator. This figure shows two cavities 1*a*, 1*b* having longitudinal axes X'X' and Y'Y' and constant cross sections; these cavities, seen in longitudinal cross section in FIG. 4 are connected to each other by a duct W in the vicinity of their first ends; the first ends of the cavities 1*a* and 1*b* are obturated whilst only the second end of the cavity 1*b* is obturated.

In the cavity 1*a* can slide a piston 2*a* integral with a rod 3*a* of axis parallel with the axis X'X'; the axis X'X' must be parallel with the direction of recoil of the firing tube but this is not obligatory for the axis Y'Y' which can make any angle with the direction of recoil of the firing tube. The piston 2*a* is provided with a seal in order to form a fluid-tight barrier inside the cavity 1*a*; similarly the rod 3*a* traverses the first obturated end of the cavity 1*a* through an orifice provided with a seal to ensure the fluid-tightness of the passage.

In the cavity 1*b* a piston 2*b* can slide along the axis Y'Y'; this piston is provided with a seal in order to form a fluid-tight barrier between the two chambers 15 and 16 which it delimits inside that cavity. The space contained between the pistons 2*a*, 2*b* and which includes the inside of the duct W and the chamber 15 is filled with a liquid 4 whilst the chamber 16 contained between the piston 2*b* and the second end of the cavity 1*b* is filled with a gas under pressure 5 and whilst the face of the piston 2*a* on the opposite side to the rod 3*a* is at atmospheric pressure; the liquid is generally oil and the gas is generally nitrogen.

When a munition is fired, the recoil is manifested by a displacement of the rod 3*a* with respect to the cavity 1*a* starting from an initial firing position; this relative displacement is symbolized by an arrow D; the recoil injects oil, via the duct W and in the direction of the arrow Ds, into the space of the cavity 2*b* contained between the duct W and the piston 2*b*. The piston retracts in the direction of the arrow Dr compressing the nitrogen contained in the chamber 16. The compressed nitrogen can then expand, pushing back the piston 2*b* which pushes back the oil toward the cavity 1*a* and therefore returns the piston-rod assembly 2*a*–3*a* to the initial firing position defined by a stop which is not shown.

Here again, like when the recoil brake is used alone or with a compensator, the firing tube can be integral either with the rod 3 and therefore the cavities 1*a*, 1*b* are fixed, or with the cavities 1*a*, 1*b* and therefore the piston-rod assembly 2*a*–3*a* is fixed. Furthermore, it should be noted that the cavities 1*a*, 1*b* have been shown separated in FIG. 4 but this is not obligatory; they could be adjoining like the two cavities of the brake with compensator shown in FIG. 3.

As a variant of the recuperator shown in FIG. 4, the gas under pressure in the cavity 16 can be replaced by a spring which works in compression during the recoil or by a spring in the cavity 15, the latter spring working in tension during the recoil.

Figure 5:
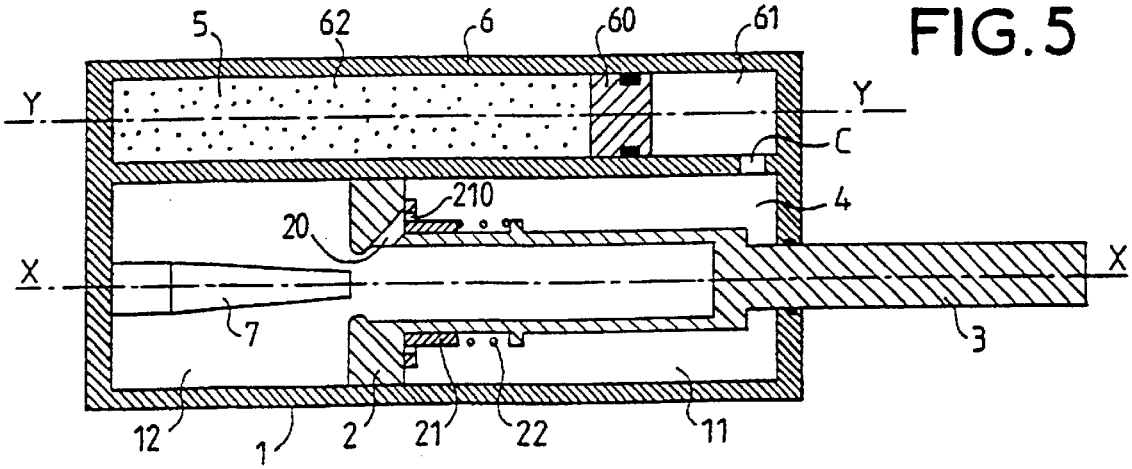
FIG. 5, is a cross sectional view of a device according to the invention.

FIG. 5 is a view in longitudinal cross section of a brake with compensator which is designed to act as a recuperator. Apart from improvements, which are not essential to its functioning, this brake corresponds to the recuperator shown in FIG. 4, wherein the end of the cavity 1*a* on the opposite side to the rod would be obstructed, wherein the piston 2*a* would intentionally not be fluid-tight and wherein the entire cavity la would be filled with liquid. However, in order to be able to function as a recuperator, the brake thus constituted must have its rod working in compression during the recoil, that is to say in any one of the configurations shown in FIGS. 2*b*, 2*d*; these configurations are those in which the effect of the recoil is to compress the gas or the spring inserted in place of the gas or of expanding the spring which, as stated with reference to FIG. 4, could be placed in the chamber 15.

In FIG. 5 there is therefore a principal cavity 1 having an axis XX, with a piston 2, a rod 3, a small chamber 11, a big chamber 12 and a secondary cavity 6 having an axis YY, with a piston 60, a secondary chamber 61 connected, through an orifice C, with the small chamber 11 and a compression chamber 62 filled with gas under pressure 5. The piston 2 is made such that it is not fluid-tight by means of holes such as 20.

It should be noted that there is a control rod 7 in the big chamber 12 and a hollow section in the piston-rod assembly 2–3 facing the rod 7. The rod 7, which is integral with the cavity 1, is profiled as a truncated cone and penetrates more or less into the hollow section of the rod 3 depending on the position of the piston 2 in the cavity 1. This control rod-hollow section assembly constitutes a conventional system for obtaining a braking pressure as constant as possible throughout the recoil.

It should also be noted, in the small chamber 11 and linked with the piston 2, that there is a valve 21 provided with a return spring 22. The valve is pierced with holes such as 210 which have a cross section of the order of four times smaller that of the holes such as 20 and the spring 22 tends to press the valve 21 against the piston 2. As long as the valve is pressed against the piston, each hole such as 210 emerges into a hole such as 20 and vice versa. Now the valve 21 is pressed against the piston 2 as long as the pressure in the big chamber 12 is less than the pressure in the small chamber increased by the pressure applied by the spring 22 the valve; the valve opens above this pressure.

FIGS. 6*a* to 6*d* again show the drawing of the brake with compensator shown in FIG. 5 in a configuration according to FIG. 2*d*, that is to say with the rod 3 fixed and the cavities 1, 6 mobile; this is symbolized by a solid block bearing the reference Ml in FIG. 6*a*.

Furthermore, a rubber shock-absorber occupies a fixed position; it is symbolized by a rectangle pressed against a solid block. These elements which bear the references N and M2 respectively in FIG. 6*a* determine a return, after recoil, to a firing position which will be called the initial position; the position in which the cavities 1, 6 come into contact with the shock absorber N.

When a munition is fired, the firing tube integral with the cavities 1, 6, drives the latter in its recoil. The cavities are in the initial position according to FIG. 6*a* at the moment the firing is initiated; the recoil brings them to a maximum rearward position as shown in FIG. 6*c*.

FIG. 6*b* shows the brake as it is during the recoil of the firing tube, in an intermediate position between the initial position and the maximum rearward position. An arrow D symbolizes the displacement of the cavities 1, 6 during the recoil; the recoil gives rise to a great increase in pressure in the big chamber 12 and hence to an opening of the valve 21 which allows a rapid passage of liquid from the big chamber to the small chamber 11; an arrow Dp symbolizes the flow of the liquid through the piston 2. The increase in pressure in the big chamber causes: a flow of liquid, symbolized by an arrow Dr, from the small chamber to the secondary chamber 61—a thrust on the piston 60 which compresses the gas enclosed in the compression chamber 62.

When the increase in pressure due to the recoil stops, the cavities 1, 6 are in the position shown in FIG. 6*c* with the valve 21 closed again; the pressure in the compression chamber 62 is at a maximum and will therefore push back the piston 60 and because of this will even cause a ref lux of liquid which results in a displacement of the cavities 1, 6 during which the En length of the rod 3 located inside the cavity 1 reduces.

FIG. 6*d* shows the brake as it is during the return to the initial position; the drawing corresponds to an intermediate position and, in this drawing, the displacements are symbolized by an arrow D' for the cavities 1, 6 and by two arrows Dr' and Dp' for the liquid; these three arrows correspond, but with opposite directions, to the three arrows D, Dr and Dp shown in FIG. 6*b*.

The return is completed by the cavities 1, 2 coming into contact with the shock absorber N, that is to say when the brake has returned to the position shown in FIG. 6*a*.

It should be noted that, due to the valve, the flow of liquid which passes from the small chamber to the big chamber is reduced and that therefore the speed of displacement, during the return, is reduced; the regulation that the brake applies to the speed of displacement of the firing tube during the return is therefore independent of the regulation that it applies to this speed during the recoil.

Here again, different variants can be proposed; in particular:—not using a control rod and using a conventional piston-rod assembly as shown in FIGS. 1 and 3—replacement of the gas by a spring working in compression in the compression chamber 62 or in tension in the secondary chamber 61, the chamber 62 then being connected to the atmosphere—secondary cavity 6 without a common wall with the primary cavity 1 and/or whose longitudinal axis has a direction different from that of the longitudinal axis of the principal cavity—piston not pierced with holes but having a cross section smaller that of the cavity in order to allow the exchange of liquid, at its periphery, between the small chamber and the big chamber.

What is claimed is:

1. An anti-recoil device comprising a recoil brake serving as a recuperator and a compensator coupled to the brake by a duct;

the brake comprising a principal cavity, a principal piston pierced with first holes and a principal rod with one end integral with the piston and one end outside of the cavity, the piston forming an imperfect barrier which subdivides the cavity into a first chamber inside of which the rod passes and a second chamber which is larger than said first chamber, the compensator comprising a subsidiary cavity, a subsidiary fluid-tight piston to delimit a subsidiary chamber inside the subsidiary cavity, and a return system which acts on the subsidiary piston to tend to reduce the volume of the subsidiary chamber, the device having its principal cavity and its subsidiary chamber filled with liquid, the duct interconnecting the first chamber and the subsidiary chamber and the system being provided in order to be used with the first chamber which increases in volume during the recoil, wherein the subsidiary chamber constitutes an empty space delimited by the subsidiary piston and the subsidiary cavity and wherein a valve is mounted on an assembly comprising the principal piston and the rod, said valve comprising second holes smaller than said principal piston first holes which are superposed on said first holes when said valve is closed to reduce the diameter of said first holes, said valve opening when the pressure in the second chamber exceeds that in the first chamber by a predetermined value.

2. The device as claimed in claim 1, which comprises a control rod integral with the principal cavity and disposed inside the second chamber wherein said assembly has a hollow section, facing the control rod, and into which the control rod penetrates depending on a position of the principal piston in the principal cavity.

3. The device as claimed in claim 1, wherein the return system comprises a fluid-tight chamber filled with a gas, said fluid-tight chamber being filled with a gas being limited by the subsidiary piston in the subsidiary cavity opposite the subsidiary chamber.

4. The device according to claim 1, wherein said second holes have a cross-section that is four times smaller than said first holes.

5. The device according to claim 1 further comprising, a solid block and a rubber shock absorber affixed to said solid block positioned to soften said recoil.

* * * * *